United States Patent [19]

Kanesaka

[11] Patent Number: 4,674,688

[45] Date of Patent: Jun. 23, 1987

[54] ACCUMULATION-TYPE FUEL INJECTOR

[75] Inventor: Hiroshi Kanesaka, Kawasaki, Japan

[73] Assignees: Usui Kokusai Sangyo Kabushiki Kaisha, Nagasawa; Kabushiki Kaisha Kanesaka Gijutsu Kenkyusho, Kawasaki, both of Japan

[21] Appl. No.: 723,824

[22] Filed: Apr. 16, 1985

[30] Foreign Application Priority Data

Oct. 8, 1984 [JP] Japan ..... 59-209855

[51] Int. Cl.[4] ..... F02M 47/02; F02M 41/16

[52] U.S. Cl. ..... 239/533.8; 239/96

[58] Field of Search ..... 239/88–96, 239/124, 125, 533.3, 533.7, 533.8, 533.9

[56] References Cited

U.S. PATENT DOCUMENTS

| | | | |
|---|---|---|---|
| 86,195 | 6/1869 | Windell et al. | 137/517 |
| 2,279,010 | 4/1942 | Nichols | 239/94 |
| 3,257,078 | 6/1966 | Mekkes | 239/533.8 X |
| 3,836,080 | 9/1974 | Butterfield et al. | 239/96 |
| 3,885,589 | 5/1975 | Iung | 137/517 X |
| 4,367,846 | 1/1983 | Akagi | 239/96 |
| 4,494,570 | 1/1985 | Adkins | 137/517 X |

*Primary Examiner*—Andres Kashnikow
*Assistant Examiner*—Patrick N. Burkhart
*Attorney, Agent, or Firm*—Anthony J. Casella; Gerald E. Hespos

[57] ABSTRACT

An accumulation type fuel injector is provided with an injector body and a needle valve guide having its one end fixed to the injector body. A nozzle body is fixed to the other end of the needle valve guide. The nozzle body is formed with an injection port and with an accumulation chamber. A needle valve is disposed in the accumulation chamber and is guided by the needle valve guide. A valve member is fitted in the injector body, and a check valve is guided by the valve member. A high-pressure fuel supply conduit is in communication with the accumulation chamber such that the needle valve opens when pressure in the fuel conduit is reduced. A controller guided by the valve member opens the check valve at the end of the fuel injection and a control piston guided by the injector body closes the needle valve.

5 Claims, 6 Drawing Figures

ACCUMULATION-TYPE FUEL INJECTOR

BACKGROUND OF THE INVENTION

1. Field of the Invention

The present invention relates to an accumulation type fuel injector for use with an internal combustion engine.

2. Description of the Prior Art

The so-called accumulation type fuel injector (referred to herein as "the injector") is intended to shorten the fuel injection period thereby to complete combustion in a short time in a so-called "sharp cut fuel injection pattern", according to which the fuel injection rate is increased to a maximum and then is cut-off abruptly, so that the isochore may be enhanced to improve the thermal efficiency of the engine. This produces low smoke emission and limits the emission of nitrogen oxides even if the injection timing is retarded.

In Conventional accumulation type fuel injectors however, the needle valve for opening and closing an injection port is so designed that the effective area thereof subject to the opening pressure is larger than that subject to the closing pressure. The valve closing pressure is lower than the valve opening pressure, so that the minimum fuel injection is determined by the difference between the two pressures. Consequently the ratio of the maximum to minimum fuel injection cannot be increased and it is substantially impossible to run the internal combustion engine at low load or no load. The prior art automatic needle valve closes in response to a drop in fuel pressure within an accumulation chamber. The effective area of the head of the needle valve is reduced when the needle valve is closed, because the head of the needle valve is seated in its valve seat. The closing of the prior art needle valve is caused by its spring which carries out the work of "(the area of its sliding portion)×(its travel)×(the pressure applied thereto)". As a result, the needle valve closes slowly in response to the difference between its opening and closing pressures not only to make the fuel injection control difficult but also to extend the injection period so that it becomes incompatible with the aforementioned objective of reducing the injection period of the accumulation type fuel injector.

My U.S. patent application Ser. No. 570,911 filed on Jan. 16, 1984 discloses an accumulation type fuel injector of the type in which a check valve is interposed between the accumulation chamber and a fuel conduit, and an injection termination control valve is disposed in a fuel passage extending between a fuel conduit communicating with the atmospheric side of the needle valve and the accumulation chamber so that a pressure is applied to the needle valve in order to increase the closing rate thereof and thereby shorten the injection period as compared with conventional accumulation type fuel injectors.

The inventor also has proposed an accumulation type fuel injector having a needle valve control piston which has an area larger than that of the sliding portion of the needle valve. The needle valve control piston is disposed on the atmospheric side of the needle valve and a throttle is interposed between the injection termination control valve and high-pressure fuel conduit so that the needle valve opens more slowly but is closed faster due to the high pressure of fuel in the accumulation chamber acting on the control piston thereby to further shorten the fuel injection period.

SUMMARY OF THE INVENTION

One object of the present invention is to enable shortening of the fuel injection period of an accumulation type fuel injector by increasing not only the opening rate but also the closing rate of the needle valve so improving the thermal efficiency of an internal combustion engine, to which the injector is fitted.

The present invention aims to improve the performance of accumulation type fuel injectors such as disclosed in the aforementioned Patent application. According to a feature of the present invention, in order to retain an area necessary for opening the needle valve, this valve has an outer diameter of the leading end its valve face larger than that of the prior arts to reduce its head and has also the ratio of an area of the valve face to that of its sliding portion larger than that of the prior arts thereby to increase its opening rate so that its opening period may be shortened.

According to a major aspect of the present invention, there is provided a fuel injector comprising: an injector body; a needle valve guide fixed at its one end to said injector body; nozzle body fixed at its one end to the other end of said needle valve guide and formed at its other end with an injection port and therein with an accumulation chamber; a needle valve disposed in said accumulation chamber and guided by said needle valve guide; a valve member fitted in said injector body; a check valve guided by said valve member; a high-pressure fuel conduit formed in said injector body for providing communication between a fuel injection pump and said accumulation chamber through said check valve so that said needle valve may be opened, when the pressure in said high-pressure fuel conduit is reduced, to inject a fuel under a high pressure to the outside via said injection port, wherein the improvement comprises: a controller guided by said valve member for opening said check valve at the end of the fuel injection; a control piston guided by said injector body and disposed in the fuel passage between said check valve and said high-pressure fuel conduit for closing said needle valve; and a conduit formed in said control piston for providing communication between said accumulation chamber and said high-pressure fuel conduit and adapted to be shut off only when said needle valve is closed.

BRIEF DESCRIPTION OF THE DRAWINGS

Embodiments of the present invention will now be described by way of example with reference to the accompanying drawings, in which.

DETAILED DESCRIPTION OF PREFERRED EMBODIMENTS

Figure 1:
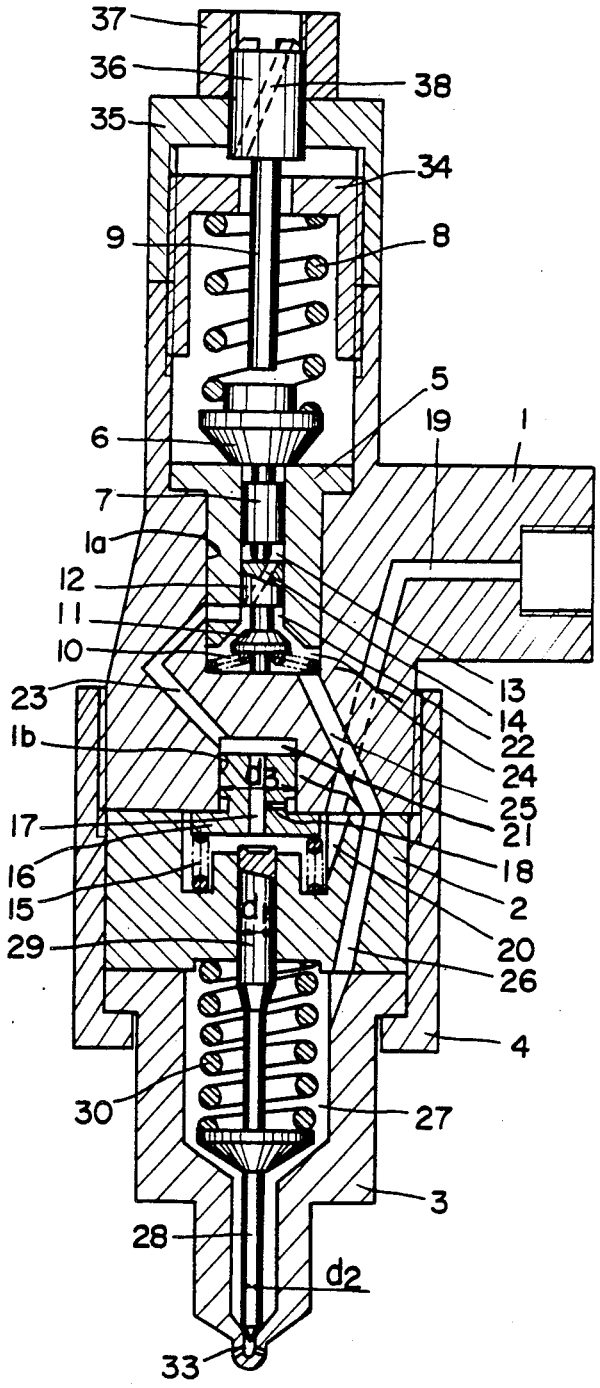
FIG. 1 is a longitudinal section of one embodiment of a fuel injector.

The fuel injector shown in the drawing comprises an injector body 1, and a needle valve guide 2 and a nozzle body 3 which are fastened to the injector body 1 by means of a nut 4.

A valve member 5 is fixed in the upper portion of the injector body 1 and has a centre bore 1*a* in which portion 7 of a controller 6 is slidable. The controller 6 is biased downwardly by a spring 8 and upward movement thereof is restricted by a stop 9. A check valve 11 which is fitted in the valve member 5, is urged upwardly by a spring 10 so as normally to block the communication from an accumulation chamber 27 to a high-pressure fuel conduit 19 (as described below). The check valve 11 has a valve guide 12 which is slidable in the centre bore 1*a* of the valve member 5, into contact with the lower end of the sliding portion 7 of the controller 6. The valve guide 12 has a hole 14 providing communication between a chamber 13, which is formed by the valve guide 12 and the sliding portion 7, and a chamber 22. Fitted in a sliding bore 1*b* formed in a lower portion of the injector body 1, is a control piston 16 which is urged upwardly by a weak spring 15 seated on an upper inside portion of the needle valve guide 2 and is formed with a conduit 17 and a throttle 18. A sliding portion of the control piston 16 has a diameter $d_3$ larger than that $d_1$ of a sliding portion 29 of a needle valve 28 (described below) so as to control closure of the needle valve 28. The aforementioned injector body 1 has a high-pressure fuel conduit 19 affording communication between an injection pump (not shown) and an injection-pump side chamber 20 which is formed at the upper end of the sliding portion 29 of the needle valve 28 above the needle valve guide 2. Also, a fuel conduit 23 communicates between a chamber 21, which is above the control piston 16 and which communicates with the chamber 20 via the conduit 17, and an injection-pump side chamber 22 of the check valve 11. A fuel conduit 25 in the injector body 1 and a conduit 26 in the needle valve guide 2 afford communication between an accumulation-chamber side chamber 24 of the check valve 11 and the accumulation chamber 27.

The aforementioned nozzle body 3, together with the lower face of the needle valve guide 2, defines the accumulation chamber 27, and the needle valve 28, the sliding portion 29 of which is a sliding fit in the centre bore of the needle valve guide 2, is biased downwardly toward its closed position, by a spring 30 acting against the valve guide 2.

Figure 2:
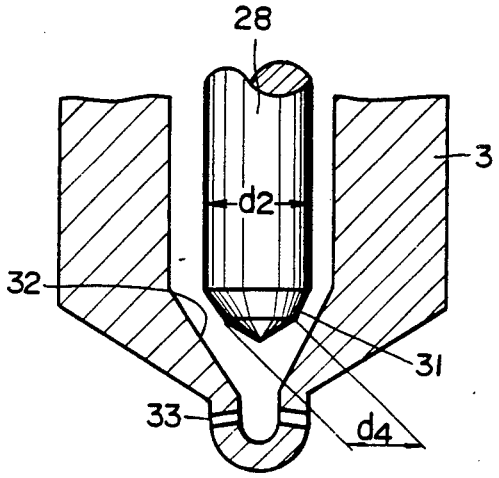
FIG. 2 is an enlarged cross-section showing the injection ports of the fuel injector of FIG. 1.

FIG. 2 shows to an enlarged scale the leading end of the needle valve 28 in its open position. A valve face 31 of the needle valve 28 tapering from a diameter $d_2$ to a leading-end diameter $d_4$ cooperates (upon closure of the valve,) with a valve seat 32 of the nozzle body 3 to shut off the fuel injection ports 33. When the needle valve 28 lifts to open the injection ports 33, as shown in FIG. 3, its upper end contacts the lower face of the control piston 16 so closing off the conduit 17 (as shown in FIG. 3).

Figure 3:
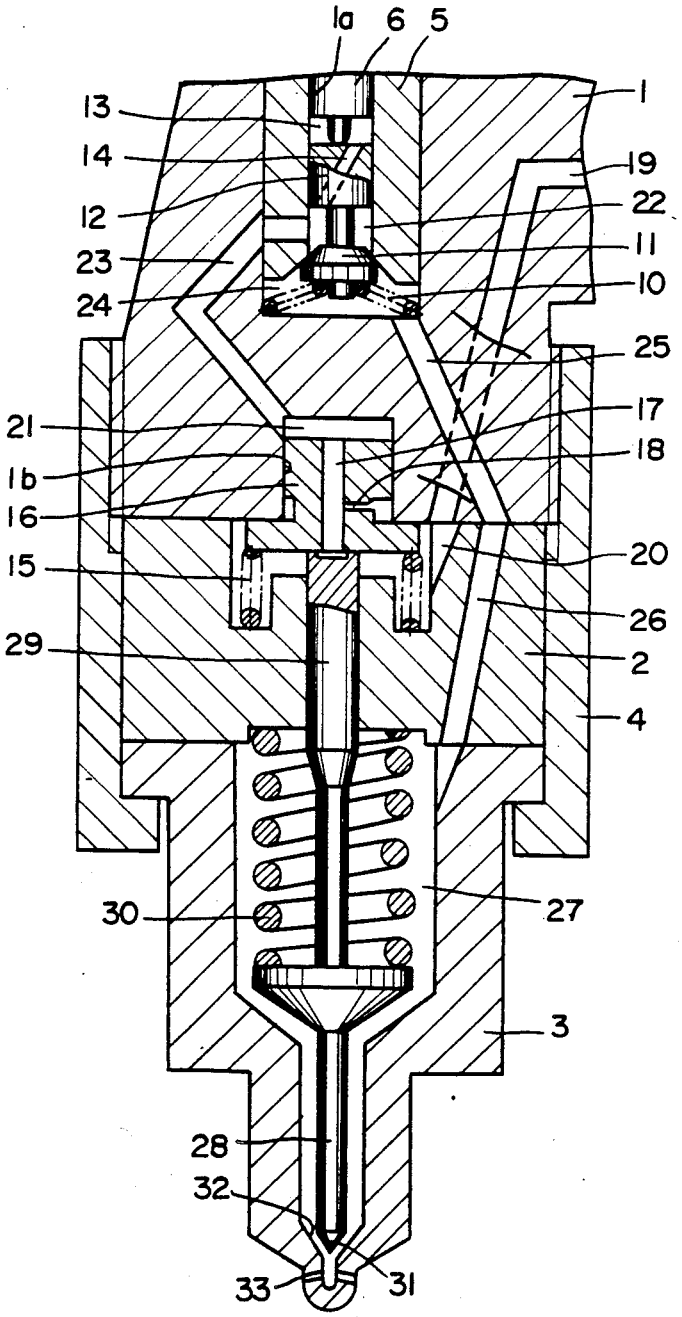
FIG. 3 is a cross-section showing a part of the fuel injector of FIG. 1, during fuel injection.

The aforementioned check valve 11 is designed such that it is closed, as shown in FIG. 3, under the combined effect of the pressure in the accumulation chamber 27 and the force of the spring 10 to shut off the passage of the fuel which would otherwise flow from the accumulation chamber 27 to the conduit 23.

FIG. 1 shows the check valve 11 held open by the controller 6, which is biased downwardly onto the upper end of the check valve 11 by a spring 8 acting between the upper end portion of the controller 6 and an adjusting screw 34 screwed in the injector body 1. When the pressure in the accumulation chamber 27 reaches the closing pressure of the needle valve 28, the force in spring 8 is greater than the sum of "(the pressure in the accumulation chamber 27)×(the area of the check valve 11) and (the force of the spring 10)" so that the check valve 11 opens to establish communication between the accumulation chamber 27 and the high-pressure fuel conduit 19.

The adjusting screw 34 is locked by a nut 35, within which is a screw 36 carrying the aforementioned stop 9 restricting movement of the controller 6. The screw 36 is itself, held by a lock nut 37 through which is formed a hole 38 so that fuel leaking past the sliding portion 7 of the controller 6, is returned to a fuel tank (not shown) through the hole 38.

A fuel injection pump having a plunger slidable in a barrel having a spill port, and a suction return valve or a residual pressure completing valve in its high-pressure fuel conduit, is suitable for use with fuel injectors according to the present invention.

FIG. 1 shows the state of the injector at a time $t_1$ (FIG. 6) prior to the onset of the supply of fuel by the injection pump.

When the timing reaches $t_2$, fuel supplied from the injection pump to the high-pressure fuel conduit 19 flows via the chamber 20, the conduit 17 and the conduit 23 to the chamber 22. From there fuel flows through the check valve 11 now opened by the controller 6 and via the conduits 25 and 26 into the accumulation chamber 27.

Figure 6:
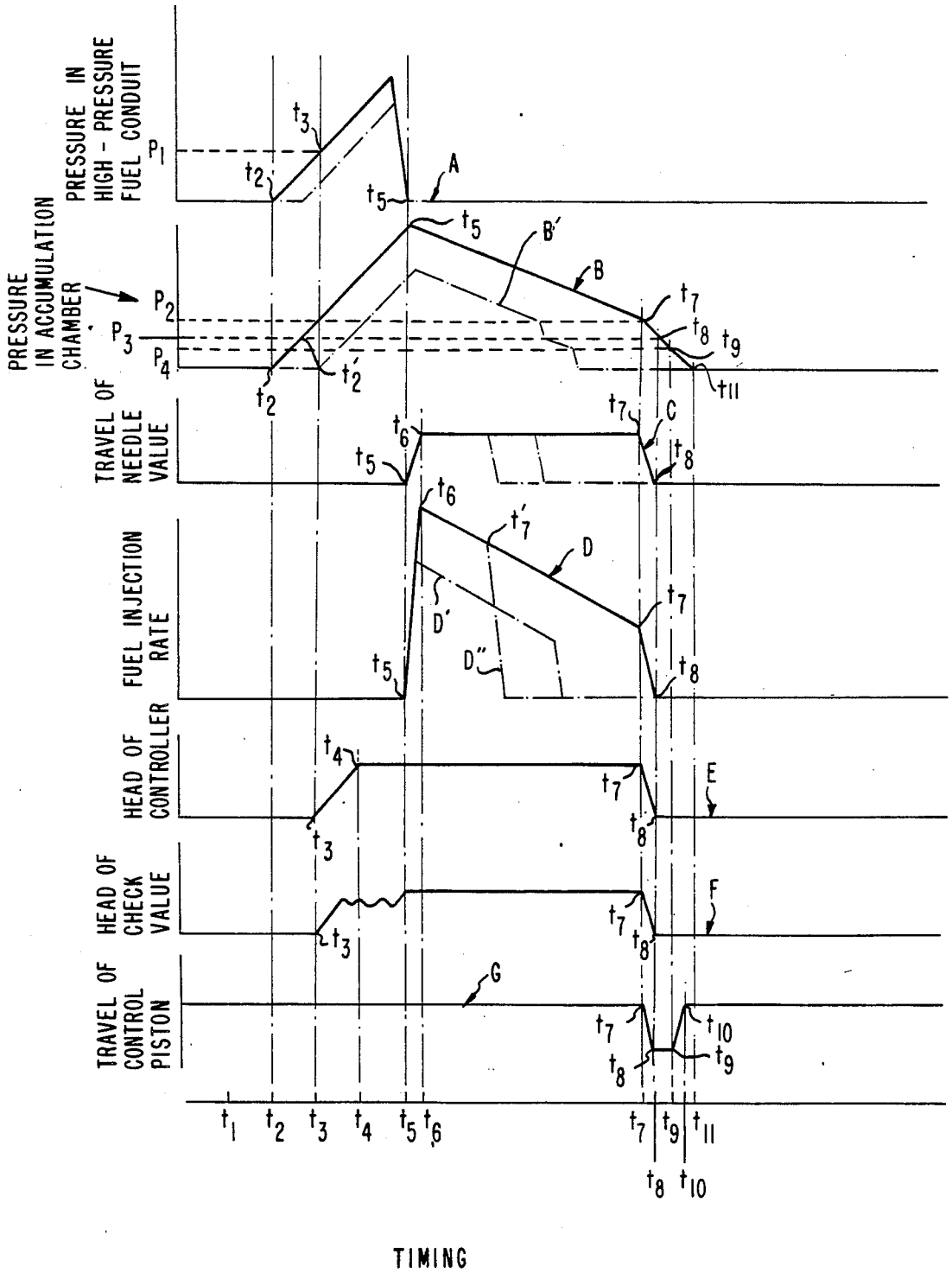
FIG. 6 shows a series of graphs illustraing the relationship between variation of presure in a high-pressure fuel conduit, the pressure in an accumulation chamber, the head and fuel injection rate of a needle valve, the head of a controller, the head of a check valve and the head of a control piston.

Since the fuel is a compressible fluid the pressure in the accumulation chamber 27 rises in proportion to the fuel supply from the injection pump, as indicated by a curve B of FIG. 6, and the pressure in the high-pressure fuel conduit 19 also rises, as indicated by a curve A.

Figure 4:
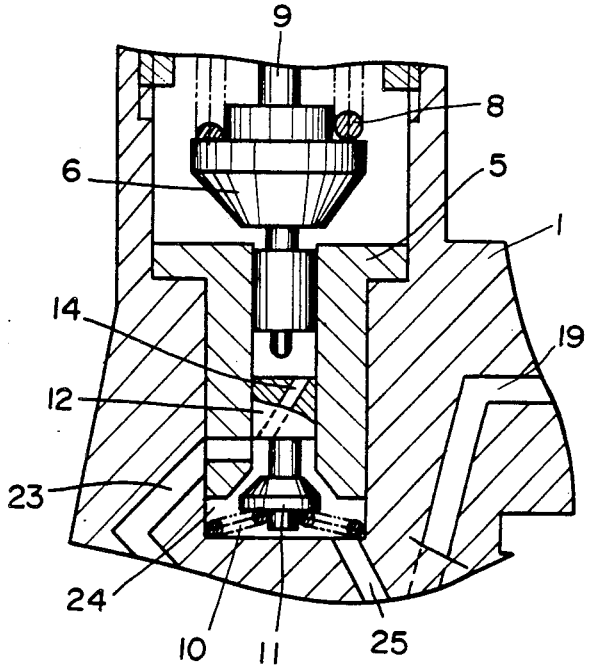
FIG. 4 is a cross-section showing a part of the fuel injector of FIG. 1, during pressure accumulation.

At $t_3$, the controller 6 is lifted against the force of the spring 8 by the pressure applied to its sliding portion 7. At $t_4$, the pressure in the accumulation chamber 27 reaches a level for terminating the fuel injection, and the controller 6 lifts, as indicated by a curve E in FIG. 6, so that the check valve 11 closes, as indicated by curve F, by the spring 10 while accompanying the controller 6. However, that fuel flow opens the check valve 11 against the force of the spring 10, as shown in FIG. 4 and continues to have its pressure boosted, as indicated by the curve B of FIG. 6, while entering the accumulation chamber 27 via the aforementioned passage from the injection pump. At this time, the head of the controller 6 contacts the stop 9.

In this state, a force $F_1$ tending to push the needle valve 28 downward is expressed by the following equation:

$$F_1 = (\text{the force in spring } 30) + \pi/4 d_1^2 \times (\text{the pressure in the chamber } 20),$$

whereas a force $F_2$ tending to lift the needle valve 28 is expressed by the following equation:

$$F_2 = (\pi/4(d_1^2 - d_2^2) \times (\text{the pressure in the accumulation chamber } 27).$$

Since the force in spring 10 is weak, the pressures in the chamber 20 above the needle valve 28 and in the accumulation chamber 27 are substantially equal so that the downward force $F_1$ is stronger than the upward force $F_2$, as is clear from the above equations. Consequently, as the pressure in the accumulation chamber 27 rises, the force tending to seat the valve face 31 is increased so that no fuel leaks from the accumulation chamber 27 to the injection ports 33.

The supply of fuel is terminated at $t_5$ when the spill port opens so that fuel flows back to the injection pump. Owing to the resulting drop in pressure, the check valve 11 is closed by the spring 10. The pressure in the high-pressure fuel conduit 19 drops abruptly but the reverse flow of fuel from the accumulation chamber 27 into the high-pressure fuel conduit 19, is blocked by the check valve 11 which is closed. As a result of the operations described above, the pressure prevailing from the check valve 11 and in the injection pump side chamber 22, the hole 14, the chamber 13, the conduit 23, the chamber 21, the conduit 17 and the chamber 20 also drops abruptly, as indicated by the curve A of FIG. 6, so that the force in spring 30 is overcome by the force $F_3$ tending to lift the needle valve 28 and given by;

$$F_3=\pi/4(d_1^2-d_2^2)\times(\text{the pressure in the accumulation chamber 27}).$$

As a result, the needle valve 28 begins to be open, and, at the same time, the pressure in the accumulation chamber 27 is applied to the valve face 31. At this instant, the effective area of the needle valve 28 changes from $\pi/4(d_1^2-d_2^2)$ to $\pi/4d_1^2$ so that the force $F_4$ tending to lift the needle valve 28 increases abruptly to a value given by the following equation;

$$F_4=\pi/4d_1^2\times(\text{the pressure in the accumulation chamber 27}).$$

The needle valve 28 is accelerated by this force $F_4$, and opens abruptly against the action of the spring 30.

In order to increase the force $F_4$ acting to accelerate opening of the needle valve 28, even when the pressure in the accumulation chamber 27 is low (i.e. when the injection rate is low), the external diameter $d_2$ of the valve face 31 is made one half or larger than the diameter $d_1$ of the sliding portion 29 as described below. If together with the external diameter $d_2$, moreover, the leading-end external diameter $d_4$ is made larger (relative to the valve seat 32) the travel necessary to open the needle valve 28 for the flow of fuel there through is reduced. As a result, the time necessary to complete the total travel of the needle valve 28, (i.e. the period from an instant $t_5$ to an instant $t_6$) can be reduced so greatly improving the valve opening response.

By contrast, in a conventional accumulation type fuel injector, the needle valve is automatically closed by the action of a spring only, and the valve opening pressure is expressed as follows:

$$(\text{the force of the spring})\div\pi/4(d_1^2-d_2^2)$$

whereas the valve closing pressure is expressed, as follows;

$$(\text{the force of the spring})\div\pi/4d_1^2.$$

This pressure difference determines the minimum rate of the fuel injection so that the diameter $d_2$ has to be made as small as possible, as compared with the aforementioned diameter $d_1$. For this reason, therefore, the needle valve of a conventional injector opens slowly and the necessary travel is so great that the opening response of the needle valve is poor.

At $t_6$ (FIG. 6) as shown in FIG. 3, the upper end of the needle valve 28 abuts the lower face of the control piston 16 so that its travel is restricted to shut off the communication between the conduit 17 and the chamber 20. At the same time, as indicated by the curve B of FIG. 6, the pressure in the accumulation chamber 27 is such that the fuel injection rate takes its maximum, as indicated by a curve D.

As fuel injection proceeds, the pressure in the accumulation chamber 27 continues to drop, as indicated by the curve B of FIG. 6, (in the state shown in FIG. 3), and the injection rate also continues to drop as indicated by the curve D. At this time, there is no leakage, as has been described hereinbefore, because the accumulation chamber 27 is closed by the check valve 11 and because the pressure in the chambers 22, 13, 21 and 20 is substantially at atmospheric pressure so that the pressures acting on control piston 16 are the same. Furthermore there is no leakage from the outer circumference of the sliding portion 7 of the controller 6 via the chamber 13 to the hole 38 because the pressure in the chamber 13 is low. At this time, only the check valve 11 and the sliding portion 29 of the needle valve 28 prevent leakage due to the large pressure difference, and the check valve 11 and sliding portion 29 may include the sealing means such as used in the prior art. As a result, the injection rate remains constant; no irregularities due to leakage occuring during fuel injection. Fuel injection continues until $t_7$ (FIG. 6) when the combined force of [(the area of the check valve 11)×(a pressure $P_2$ in the accumulation chamber 27)]+(the force in the spring 10) can not compete will the force of the spring 8 so that the controller 6 is pushed downward to open the check valve 11. As a result, high pressure fuel flows from the accumulation chamber 27 into the chamber 21 via the conduits 26 and 25 and the chamber 24 through the check valve 11 and further via chamber 22 and the conduit 23. The lower end of the conduit 17 of the control piston 16 is still shut off by the upper end face of the needle valve 28, as shown in FIG. 3 so that the pressure in the chamber 21 equalizes with the pressure in the accumulation chamber 27. Also, since the pressure in the chamber 20 has dropped to a level near the atmospheric level, as has been described above, the force $F_5$ tending to push the needle valve 28 downward is given by the following equation;

$$F_5=\pi/4d_3^2\times(\text{the pressure in the accumulation chamber 27})+(\text{the force in spring 30})-(\text{the force in spring 15}).$$

whereas the force $F_6$ tending to push the needle valve 28 upward is given by the fo11owing equation:

$$F_6=\pi/4d_1^2\times(\text{the pressure in accumulation chamber 27})$$

Because the force in spring 15 becomes negligible because of the aforemention weakness thereof and because $d_3>d_1$ it follows that the downward force $F_5$ is greater than the upward force $F_6$ so that the applied force $F_7=F_5-F_6$ causes the needle valve 28 to accelerate.

At this time, the energy to be consumed is expressed, as follows:

$$\pi/4(d_1^2-d_1^2)\times(\text{the pressure in the accumulation chamber } 27)\times(\text{the travel of the needle valve } 28).$$

As a result of this loss in energy, the pressure in the accumulation chamber 27 drops to a level $P_3$, as indicated by the curve B, at $t_8$.

In the injector of the present invention, the needle valve 28 is not automatic and the closing rate thereof can be increased by appropriate setting of the aforementioned force and needle valve travel as described above, whereby the closing period, i.e. the period from $t_7$ to $t_8$ can be reduced to produce the so-called "sharp cut". Also, during the period $t_8$ to $t_9$, the control piston 16 continues to bear on the needle valve 28, as indicated by a curve G and shown in FIG. 5, and the fuel in the accumulation chamber 27 flows through the sole passage, i.e. the throttle 18 and enters the chamber 20 at low pressure so that the pressure in the accumulation chamber 27 and in the chamber 21 gradually drops until at $t_9$ it reaches the level indicated by $P_4$ in curve B, which pressure is given by:

$$P_4=(\text{the pressure in the chamber } 21)\times\pi/4d_3^2<(\text{the force of the spring } 15).$$

As a result, the control piston 16 is pushed upward by the spring 15 until at $t_{10}$, it reaches the position shown in FIG. 1.

Figure 5:
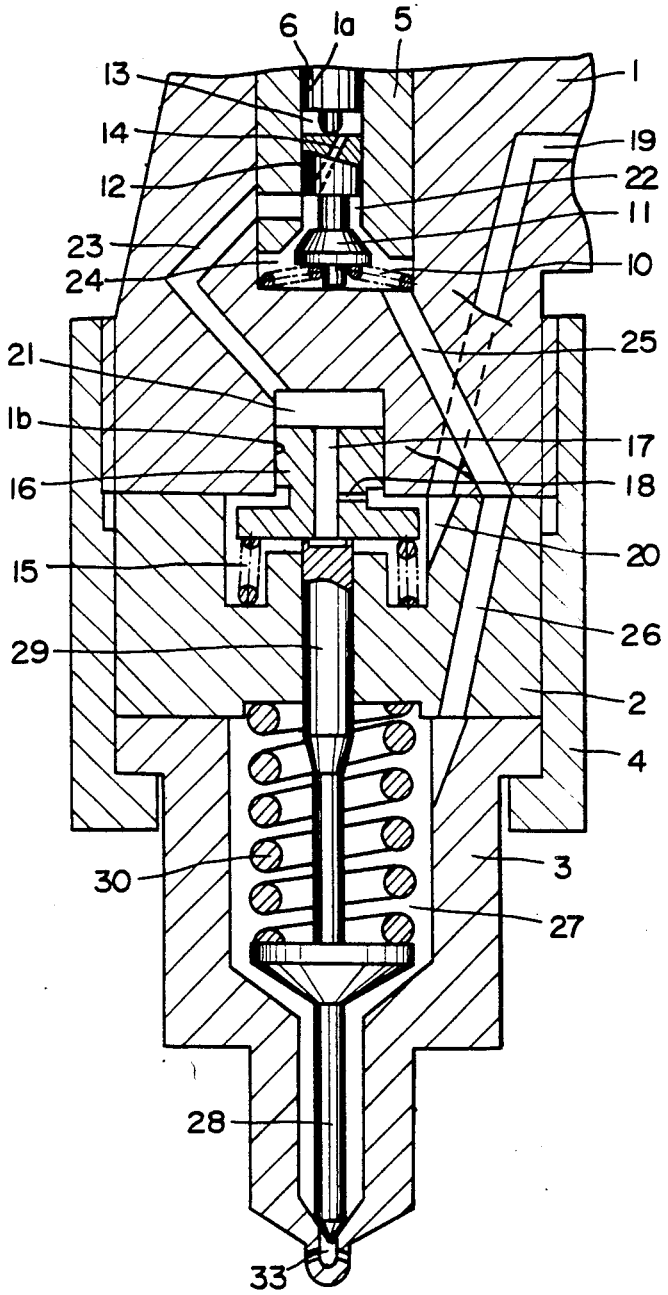
FIG. 5 is a cross-section showing a part of the fuel injector of FIG. 1 during valve closure.

The conduit 17 which at that time depicted in FIG. 5 is closed by the upper end of the needle valve 28 then becomes opened so that fuel at pressure $P_4$ flows from the accumulation chamber 27 via the conduit 17 to be returned to the injection pump (not shown) via the chamber 20 and the high-pressure fuel conduit 19. At $t_{11}$, the cycle is complete and the injector returned to the initial ($t_1$) state as shown in FIG. 1.

Adjustment of the fuel injection is achieved as in the prior art. To reduce fuel injection, for example, the maximum pressure in the accumulation chamber 27 is lowered, as indicated by a curve B', by throttling the fuel supply thereto from the injection pump as indicated by a single-dotted curve of FIG. 6. When its closing pressure is reached, the needle valve 28 closes abruptly, as described above, so that the injection rate changes, as indicated by a single-dotted curve D', so reducing its integral, i.e. the fuel injection. If the throttle 18 of the control piston 16 and the spring 15 are omitted, the control piston 16 and the needle valve 28 adopt the positions shown in FIG. 5 during the period $t_8$ to $t_2'$ of FIG. 6. When the pressure in the high-pressure fuel conduit exceeds $P_3$ at $t_2'$, the control piston 16 is lifted to the position shown in FIG. 1, so that the fuel continues to flow. As a result, the presence of absence of throttle 18 neither changes nor restricts operations.

Reference has already been made to the controller 6 functioning both as a sensor for sensing the pressure in the accumulation chamber 27 and as an actuator for opening the check valve, as shown in FIG. 1. Alternatively, however, if, the fuel supply rate of the injection pump is arranged such that the pressure in accumulation chamber at the instant $t_5$ is always the same constant, as shown in FIG. 6, fuel injection may be controlled in accordance with curve D, by using a timing sensor (such as a clock) to initiate closing of the needle valve 28 at time $t_7'$ by actuating the controller 6 using a hydraulic or electrical actuator to open the check valve 11, and by forcibly closing the needle valve 28 by means of the control piston 16.

As already described, the opening pressure of the needle valve 28 may be determined by selecting the diameter $d_1$ of the sliding portion 29, the external diameter $d_2$ of the valve face 31 and the force exerted by the spring 30 and its closing pressure may be determined by the area of the check valve 11 and the force in the spring 8. This makes it possible to ensure that the difference between the opening and closing pressures of the needle valve 28 is small thereby to reduce the minimum fuel injection. Also, the use of a needle valve 28 having a reduced difference between the external diameter $d_1$ of its sliding portion 29 and the external diameter $d_2$ of its valve face 31, enables reliable and prompt opening of an accumulation chamber type fuel injector without any irregular injection. Moreover, controller 6 forcibly opens the check valve 11 to apply the pressure in the accumulation chamber 27 to the control piston 16, which has the diameter $d_3$ larger than that $d_1$ of the sliding portion 29 of the needle valve 28, thereby to depress and close the needle valve 28. As a result, the rate at which the needle valve 28 closes can be increased to reduce the minimum injection of the fuel. Also, the fuel injection period is shortened to artificially increase the injection rate so that the combustion of fuel in the engine and hence the thermal efficiency of the engine is enhanced by increasing the heat liberation and enhancing the isochore.

Even when the injection timing is retarded, it is possible to ensure that combustion produces relatively little environmental pollution, such as black smoke and nitrogen oxides.

I claim:

1. An accumulation type fuel injector for abruptly terminating injection of fuel, said fuel injector having a needle valve operable to open and close an injection port in communication with an accumulation chamber, a control piston movably mounted in a chamber of said fuel injector for selectively closing the needle valve, said control piston including a conduit therethrough, fuel supply passage through which fuel under pressure is supplied to the chamber of the control piston and to the accumulation chamber via the conduit in the control piston and via a check valve, such that the needle valve opens to start the injection of fuel in response to pressure of fuel in the accumulation chamber and a reduction of the pressure in the fuel supply passage and in the chamber of the control piston, a controller arranged to open the check valve at the end of the fuel injection period, such that the fuel under pressure in the accumulation chamber acts on the control piston via the opened check valve and the chamber of the control piston to urge the needle valve into a closed position and thereby contribute to abrupt termination of fuel injection.

2. A fuel injector for abruptly terminating the injection of fuel comprising: an injector body; a needle valve guide fixed at one end thereof to the injector body; and at the other end thereof to one end of a nozzle body formed at its other end with an injection port and therein with an accumulation chamber; a needle valve disposed in said accumulation chamber and guided by said needle valve guide to open and close the injection port, a control piston movable mounted a chamber intermediate said injector body and said valve guide for selectively closing the needle valve, said control piston including a conduit extending therethrough; a valve member fitted in the injector body; a check valve guided by said valve member; a high-pressure fuel conduit affording communication between a fuel injection pump and the accumulation chamber through the conduit in the control piston and the check valve so that the needle valve may be opened to inject a fuel at high pressure in response to the pressure of fuel in the accumulation chamber and a reduction of the pressure in the high-pressure fuel conduit, a controller guided by the valve member for opening the check valve at the end of the fuel injection; whereby the pressure of fuel in the accumulation chamber acts upon the control piston when the check valve is opened to urge the needle valve into a closed pistion and thereby contribute to abrupt termination of fuel injection.

3. A fuel injector according to claim 1 or claim 2, wherein a guided sliding portion of the control piston has a diameter larger than that of a guided sliding portion of the needle valve for controlling closing of the needle valve.

4. A fuel injector according to claim 1 wherein the needle valve has its leading end tapering from the valve face of the needle valve having an enlarged diameter so as to reduce needle valve travel to increase the opening rate thereof thereby to shorten the valve opening period.

5. A fuel injector according to claim 2, wherein the needle valve has its leading end tapering from the valve face of the needle valve having an enlarged diameter so as to reduce needle valve travel to increase the opening rate thereof thereby to shorten the valve opening period.

* * * * *